United States Patent [19]

Nishino

[11] Patent Number: 4,976,604

[45] Date of Patent: Dec. 11, 1990

[54] PULSE COMBUSTION APPARATUS

[75] Inventor: Hiroshi Nishino, Chita, Japan

[73] Assignee: Paloma Kogyo Kabushiki Kaisha, Nagoya, Japan

[21] Appl. No.: 380,770

[22] Filed: Jul. 17, 1989

Related U.S. Application Data

[63] Continuation of Ser. No. 246,997, Sep. 20, 1988, abandoned.

[30] Foreign Application Priority Data

Oct. 2, 1987 [JP] Japan ..... 62-249237

[51] Int. Cl.[5] ..... F23C 11/04

[52] U.S. Cl. ..... 431/1

[58] Field of Search ..... 431/1; 122/24; 60/39.76, 39.77, 39.8, 247, 249

[56] References Cited

U.S. PATENT DOCUMENTS

| | | | |
|---|---|---|---|
| 3,186,381 | 6/1965 | Haag | 431/1 X |
| 3,395,967 | 8/1968 | Karr | 431/1 |
| 3,469,929 | 9/1969 | Haag | 431/1 |
| 3,606,867 | 9/1971 | Briffa | 431/1 X |
| 4,639,208 | 1/1987 | Inui et al. | 431/1 |

FOREIGN PATENT DOCUMENTS

| | | | |
|---|---|---|---|
| 0207811 | 10/1985 | Japan | 431/1 |
| 0207812 | 10/1985 | Japan | 431/1 |
| 0211209 | 10/1985 | Japan | 431/1 |
| 0216106 | 10/1985 | Japan | 431/1 |

*Primary Examiner*—Carl D. Price

*Attorney, Agent, or Firm*—Lahive & Cockfield

[57] ABSTRACT

A pulse combustion apparatus comprises (i) a single air supply section with a single air blower and (ii) a plurality of combustion sections each communicating with the air supply section. The air supply section includes passages communicating with both the blower and the respective combustion sections for admitting air from the blower into the respective combustion sections. The air admitting passages are physically separated from each other for separating air from the blower into streams which are not able to join together anywhere.

2 Claims, 2 Drawing Sheets

PULSE COMBUSTION APPARATUS

This application is a continuation of application Ser. No. 246,997, filed Sept, 20, 1988, abandoned.

FIELD OF THE INVENTION

This invention relates to a pulse combustion apparatus for use as a heating source for a machine which needs to heat liquid to perform its function, such as a hot-water-storing type hot water supply machine, a fryer, a noodle boiling machine or the like and in particular such a machine for commercial use.

BACKGROUND OF THE INVENTION

A pulse combustion apparatus comprises (i) a combustion section or sections each chiefly including a burner, a combustion chamber, a tail pipe and an exhaust muffler and (ii) an air supply section chiefly including an air blower and a supply muffler. In the apparatus combustion repeats itself many times. To be more exact, in the apparatus a series of air/fuel mixture supply, explosion, combustion, expansion and exhaust occurs in some 60 to 150 cycles per second. In use, the combustion chamber and the tail pipe are disposed within a tank (hot-water tank or oil tank) of a machine, such as a hot-water-storing type hot water supply machine, a fryer, or a noodle boiling machine. With a pulse combustion apparatus, it is almost impossible to control the combustion capacity of the burner of the combustion section, especially due to the construction and the combustion manner of the apparatus. Thus, with a pulse combustion apparatus having only one combustion section, it is almost impossible to control the quantity of the heat produced by the apparatus. Therefore, where there is the necessity for such a controllability, a pulse combustion apparatus with two or more combustion sections is produced. With such an apparatus, it is possible to control the quantity of the heat produced thereby by causing combustion to take place in all the combustion sections at one time and in only one or more of the combustion sections at another time.

One example of a prior art pulse combustion apparatus with such a construction is shown in FIG. 3. The apparatus of FIG. 3 includes a pair of combustion sections A each having a combustion chamber 2 and an air supply section B which supplies air into each combustion chamber. The air supply section B includes (i) an air blower F with a supply outlet 13, (ii) a supply muffler 10, (iii) a pair of air introducing channels 11 and (iv) a pair of air chambers 12. The construction from the supply outlet 13 to the air chambers 12 provides a single air admitting passage C for common use by the two combustion sections A. The rotating speed of the air blower F and, hence, the rate of supply of air of the supply section B into the combustion chambers 2 are set at a given value required for combustion in both the combustion chambers 2. Thus, initially, combustion certainly can be started, as desired, in one or both of the two combustion chambers 2. And once combustion starts in each chamber 2 in a steady state, each chamber 2 is "self-sustaining", or draws, by itself, the air within the section B into itself thanks to the negative pressure which is created, within the chamber 2, by the combustion products produced therein and flowing toward an exhaust pipe. In other words, once proper combustion takes place in each section A, each section A is automatically supplied with the air without operating the blower F. However, if and when the blower F is restarted to start or restart combustion in one of the combustion chambers 2 while combustion is taking place only in the other combustion chamber, the "inactive" combustion chamber is only supplied with an amount of air which is considerably smaller than that predetermined by the rotating speed of the blower F. The reason for this is that the bulk of the air from the blower F is drawn by the "active" combustion chamber because of the above-mentioned "self-sustaining" character of the "active" combustion chamber. Thus, in such a case, the ignition of the air/fuel mixture does not take place as expected, or is delayed, in the "inactive" chamber.

In order to obviate such a defect, the applicant has proposed, in Japanese Patent Application No. 62-86503, a pulse combustion apparatus whereby an air blower is rotated at a speed higher than the normal, or fundamental speed when combustion is to be started or restarted in an "inactive" combustion chamber while it is taking place only in another combustion chamber, thereby supplying the "inactive" combustion chamber with the amount of air which enables proper combustion to take place in it even in such a state. However, such a proposal calls for the provision of a means for determining when combustion is to be started or restarted in the "inactive" combustion chamber, as well as the provision of a means for increasing the rotating speed of the blower.

SUMMARY OF THE INVENTION

It is an object of the invention to provide a pulse combustion apparatus having a plurality of combustion sections and having air admitting passages provided for the respective combustion sections.

Another object of the invention is to provide a pulse combustion apparatus having a plurality of combustion sections and whereby, if and when combustion is taking place in only one combustion section, substantially equal amounts of air from an air blower can be supplied into the respective combustion sections without taking any particular step, including a higher-speed rotation of the blower.

DETAILED DESCRIPTION OF THE PREFERRED EMBODIMENTS

Figure 1:
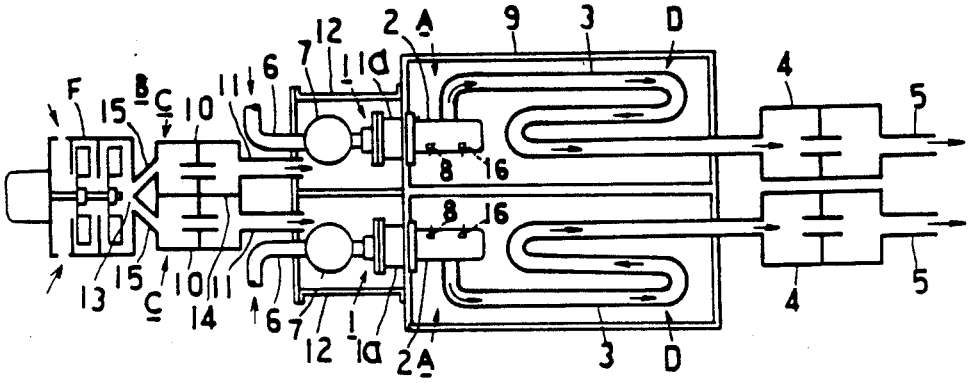
FIG. 1 shows a pulse combustion apparatus constructed according to a preferred embodiment of the invention.

Referring now to the drawing, FIG. 1 shows a pulse combustion apparatus which embodies the invention in one preferred form. The apparatus comprises a pair of combustion sections A and an air supply section B. Each combustion section A includes a burner section 1, a combustion chamber 2, a tail pipe 3, an exhaust muffler 4 and an exhaust pipe 5. The air supply section B includes an air blower F, a pair of supply mufflers 10, a pair of air introducing channels 11 and a pair of air chambers 12.

The burner section 1 of each combustion section A is located within one of the air chambers 12. In each chamber 12 a fuel chamber 7 is connected to the burner section 1. The burner section 1 has an air/fuel mixing chamber 1*a*. A fuel introducing conduit 6 is connected to each chamber 7. Initially a suitable amount of fuel gas is introduced through each conduit 6 in a forced manner, and the fuel enters the chamber 7 where the fuel is placed under a uniform pressure. Then, the fuel enters the mixing chamber 1*a* through a disc-type gas valve (not shown). Also initially, the blower F is operated to supply air into each chamber 12. In the chamber 12 the air is placed under a uniform pressure, and then the air enters the mixing chamber 1*a* through a disc-type air valve (not shown). The fuel and the air in the chamber 1*a* are mixed together. The mixture flows into the combustion chamber 2. Then, in the chamber 2 the mixture is ignited in a forced manner, or by an ignition plug 8 provided in the chamber 2. And when the combustion starts in a steady state, not only the forced supply of air by operating the blower F and of the fuel gas through the conduit 6, but also the forced ignition of the mixture by the plug 8 is stopped. Thereafter, thanks to its "self-sustaining" character, the chamber 2 draws, by itself, both the air from the section B and fuel gas. Also, thereafter, the air/fuel mixture thus drawn into the chamber 2 ignites itself. Thus, thereafter, the combustion in the chamber 2 repeats itself automatically. In this connection, it will be appreciated by those skilled in the art that a portion of the combustion gas which has flowed through the tail pipe 3 may return into the chamber 2 or a portion of the combustion gas may remain in the chamber 2, and such a portion of the combustion gas ignites the mixture in the chamber 2. The self-ignition of the mixture thus occurs.

In use, the combustion chambers 2 and the tail pipes 3 are located within a tank 9 of a machine such as a hot-water-storing type hot water supply machine, a fryer, or a noodle boiling machine. The tail pipes 3 function as heat exchangers D.

Figure 2:
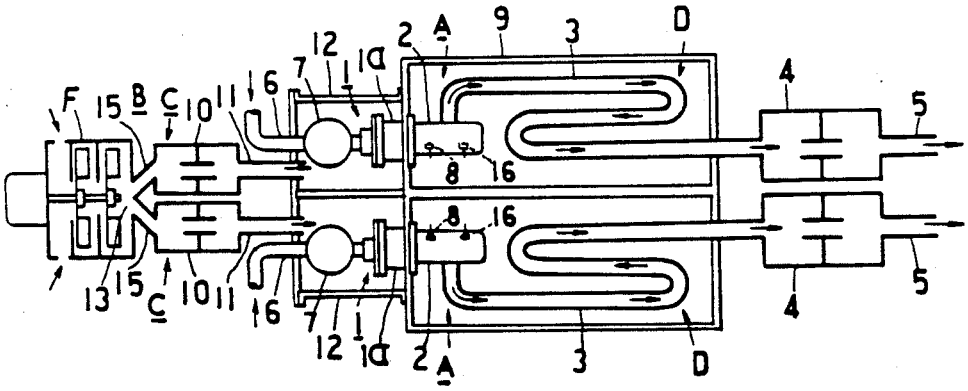
FIG. 2 shows a pulse combustion apparatus constructed according to another preferred embodiment of the invention.
Figure 3:
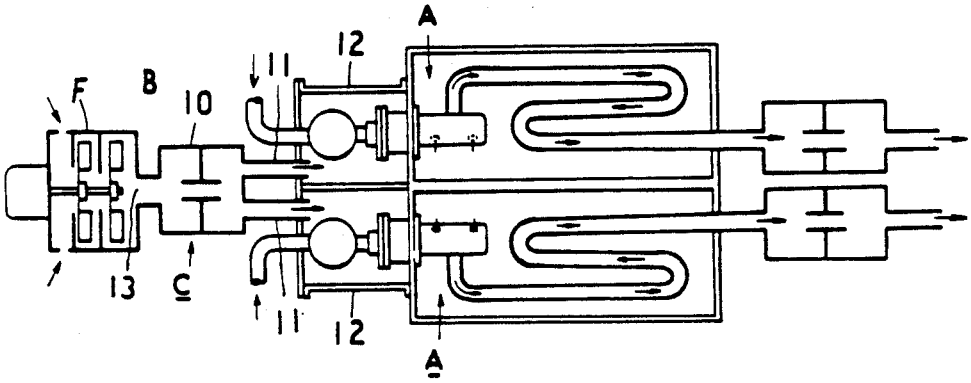
FIG. 3 ( PRIOR ART )
FIG. 3 shows a pulse combustion apparatus of the prior art.

Numeral 13 of FIG. 1 designates a supply outlet of the blower F. The supply outlet 13 is connected to each supply muffler 10 by means of a pair of flow dividers 15. The supply mufflers 10 are formed of a single enclosure, and are separated from each other by a central partition wall 14 of the enclosure. The mufflers 10 are connected to the respective air chambers 12 by the respective air introducing channels 11. A pulse combustion apparatus of FIG. 2 according to another embodiment of the invention has exactly the same construction as that of FIG. 1 except that a pair of mufflers 10 are formed not of a single enclosure, but of separate enclosures. In each embodiment it will be appreciated that the construction from the supply outlet 13 to the air valves (not shown) located within the respective chambers 12 is distinctly separated into a pair of air admitting passages C. That is, one of the flow dividers 15, the associated muffler 10, the associated introducing channel 11 and the associated chamber 12 constitutes one air admitting passage C. As clearly shown in FIGS. 1 and 2, one of the passages C is used to supply air into the mixing chamber 1*a* of one of the combustion sections A, and the other passage C is used to supply air into that of the other combustion section A. Thus, whenever the blower F is started or restarted, substantially equal amounts of air are certainly supplied, through the respective passages C, into both the combustion chambers 2 whether combustion is or is not taking place in either of the chambers 2.

Numeral 16 designates a flame detector means provided within each chamber 2 for determining whether a flame exists in the chamber 2.

What is claimed is:

1. A pulse combustion apparatus having plural pulse combustion sections which may be operated separately or together so that the heat output of the apparatus may be varied by varying the number of sections which are combusting, such apparatus comprising, (i) a single air supply section with a single air supply source including a housing and a blower which is operated at a single speed for providing a flow of air under pressure from said housing, (ii) a plurality of combustion sections each communicating with the air supply section, the air supply section including air passages which branch out from each other at an outlet of the housing, such air passages communicating with both the housing and the respective combustion sections for admitting air from the housing into the respective combustion sections, said air passages being physically separated from each other for separating the air from the housing into streams which are not able to join together anywhere, each of said air passages having an air valve therein, (iii) a plurality of air/fuel mixing chambers provided in the respective combustion sections, said mixing chambers being located on downstream sides of the respective air passages and (iv) a plurality of fuel passages communicating with the respective mixing chambers, each of said fuel passages having a fuel valve therein, each of the air passages effectively connecting the air supply source to one of the mixing chamber such that a non-combusting one of the combustion sections receives an effective flow of air from the blower operating a said single speed for starting and running normally even when a combusting one of the combustion sections is drawing air from the air supply source.

2. A pulse combustion apparatus comprising (i) a single air supply source including a housing and a blower which is operated at a single speed to provide a flow of air under pressure from said housing, (ii) plural combustion sections capable of being operated separately or together so that the heat output of the apparatus may be varied by varying the number of sections which are combusting, (iii) air passages connecting the air supply source and the combustion sections to admit air from the air supply source into the respective combustion sections and including (a) mufflers located adjacent to the air supply source on downstream sides thereof and connected separately to the air supply source by plural flow dividing means which branch from each other at an outlet of the housing at an angle and extending to plural respective mufflers, and (b) air/fuel mixing chambers located on downstream sides of the respective mufflers, said air passages being physically completely separated from each other for separating the air from the housing into streams which do not join together, and (iv) fuel passages communicating with the respective mixing chambers, said air passages delivering an effective amount of air from said blower at said single speed to start combustion in all chambers simultaneously and also to start combustion in one chamber even while the other chamber is combusting and drawing air through a said air passage.

* * * * *